US012257664B2

(12) United States Patent
Song et al.

(10) Patent No.: US 12,257,664 B2
(45) Date of Patent: Mar. 25, 2025

(54) CONTROLLING CHEMICAL MECHANICAL POLISHING PAD STIFFNESS BY ADJUSTING WETTING IN THE BACKING LAYER

(71) Applicant: Applied Materials, Inc., Santa Clara, CA (US)

(72) Inventors: Kevin H. Song, San Jose, CA (US); Benedict W. Pang, Burlingame, CA (US)

(73) Assignee: Applied Materials, Inc., Santa Clara, CA (US)

( * ) Notice: Subject to any disclaimer, the term of this patent is extended or adjusted under 35 U.S.C. 154(b) by 700 days.

(21) Appl. No.: 16/800,777

(22) Filed: Feb. 25, 2020

(65) Prior Publication Data

US 2020/0276685 A1 Sep. 3, 2020

Related U.S. Application Data

(60) Provisional application No. 62/841,769, filed on May 1, 2019, provisional application No. 62/812,212, filed on Feb. 28, 2019.

(51) Int. Cl.
*B24B 37/00* (2012.01)
*B24B 37/005* (2012.01)
(Continued)

(52) U.S. Cl.
CPC ..... *B24B 37/005* (2013.01); *B24B 37/22* (2013.01); *B24B 37/26* (2013.01); *B24B 53/00* (2013.01)

(58) Field of Classification Search
None
See application file for complete search history.

(56) References Cited

U.S. PATENT DOCUMENTS 5,246,525 A 9/1993 Sato
5,287,663 A 2/1994 Pierce et al.
(Continued)

FOREIGN PATENT DOCUMENTS

CN 1939667 4/2007
CN 100367920 C * 2/2008 ..... A61F 13/15203
(Continued)

OTHER PUBLICATIONS

Prasad et al., "The effect of polymer hardness, pore size, and porosity on the performance of thermoplastic polyurethane-based chemical mechanical polishing pads", Feb. 2013, J. Mater. Res., vol. 28, No. 17, Sep. 14, 2013. (Year: 2013).*
(Continued)

*Primary Examiner* — Mohammad Ali
*Assistant Examiner* — Kelvin Booker
(74) *Attorney, Agent, or Firm* — Fish & Richardson P.C.

(57) ABSTRACT

A polishing pad for a chemical mechanical polishing apparatus includes a polishing layer having a polishing surface and a backing layer formed of a fluid-permeable material. The backing layer includes a lower surface configured to be secured to a platen and an upper surface secured to the polishing layer, wherein the lower surface and upper surface are sealed. A first seal circumferentially seals an edge of the backing layer, and a second seal seals and separates the backing layer into a first region and a second region surrounded by the first region.

20 Claims, 5 Drawing Sheets

(51) Int. Cl.

| | |
|---|---|
| ***B24B 37/22*** | (2012.01) |
| ***B24B 37/26*** | (2012.01) |
| ***B24B 37/32*** | (2012.01) |
| ***B24B 53/00*** | (2006.01) |

(56) References Cited

U.S. PATENT DOCUMENTS

| | | | | |
|---|---|---|---|---|
| 5,708,506 | A * | 1/1998 | Birang | B24B 49/12 356/600 |
| 5,882,243 | A * | 3/1999 | Das | B24B 49/04 451/63 |
| 6,142,857 | A | 11/2000 | Cesna | |
| 6,187,681 | B1 * | 2/2001 | Moore | B24B 37/24 438/692 |
| 6,217,426 | B1 * | 4/2001 | Tolles | B24B 37/26 451/526 |
| 6,227,955 | B1 * | 5/2001 | Custer | B24B 37/32 438/692 |
| 6,241,585 | B1 | 6/2001 | White | |
| 6,267,659 | B1 * | 7/2001 | Chen | B24B 37/22 451/287 |
| 6,368,189 | B1 * | 4/2002 | Maloney | B24B 37/32 451/63 |
| 6,402,591 | B1 * | 6/2002 | Thornton | B24B 37/11 451/63 |
| 6,464,576 | B1 * | 10/2002 | Freeman | B24B 37/26 451/538 |
| 6,722,949 | B2 * | 4/2004 | Hu | B24B 37/26 451/36 |
| 6,764,387 | B1 | 7/2004 | Chen | |
| 6,913,518 | B2 | 7/2005 | Chen et al. | |
| 6,924,641 | B1 * | 8/2005 | Hanawa | B24B 37/205 324/226 |
| 7,070,480 | B2 * | 7/2006 | Moon | B24B 37/26 451/36 |
| 7,112,119 | B1 * | 9/2006 | Swedek | B24D 18/00 451/6 |
| 7,753,896 | B2 * | 7/2010 | Collado | A61F 13/15203 604/374 |
| 8,062,098 | B2 * | 11/2011 | Duescher | B24B 37/14 451/550 |
| 8,272,922 | B2 * | 9/2012 | Duong | C08L 75/04 451/36 |
| 9,358,658 | B2 * | 6/2016 | Chang | B24B 37/005 |
| 10,201,887 | B2 * | 2/2019 | Chen | B24B 37/30 |
| 11,154,959 | B2 | 10/2021 | Lehuu et al. | |
| 2001/0013503 | A1 * | 8/2001 | Custer | B24B 37/32 216/13 |
| 2001/0014537 | A1 * | 8/2001 | Moore | B24B 49/14 438/692 |
| 2002/0137435 | A1 * | 9/2002 | Hu | B24D 7/10 451/36 |
| 2002/0193059 | A1 * | 12/2002 | Freeman | B24B 37/22 451/550 |
| 2003/0013384 | A1 * | 1/2003 | Donohue | B24B 37/26 451/41 |
| 2003/0201770 | A1 * | 10/2003 | Hanawa | G01B 7/105 324/229 |
| 2005/0032464 | A1 * | 2/2005 | Swisher | B24B 37/22 451/41 |
| 2005/0221730 | A1 * | 10/2005 | Kiermasz | B24B 53/017 451/56 |
| 2006/0160478 | A1 * | 7/2006 | Donohue | B24B 37/26 451/285 |
| 2007/0015448 | A1 * | 1/2007 | Swisher | B24B 37/22 451/526 |
| 2007/0049167 | A1 * | 3/2007 | Swedek | B24B 37/205 451/6 |
| 2008/0188163 | A1 * | 8/2008 | Duong | C08L 75/04 451/36 |
| 2010/0003904 | A1 * | 1/2010 | Duescher | B24B 37/245 51/293 |
| 2010/0120334 | A1 * | 5/2010 | Crocco | B24B 49/16 451/287 |
| 2011/0143539 | A1 * | 6/2011 | Bajaj | B24B 49/12 438/692 |
| 2011/0239876 | A1 | 10/2011 | Brown | |
| 2012/0171933 | A1 * | 7/2012 | Chen | B24B 37/12 451/259 |
| 2014/0273765 | A1 * | 9/2014 | Chang | B24B 37/042 451/259 |
| 2014/0273766 | A1 * | 9/2014 | Chang | B24B 37/005 451/259 |
| 2015/0298284 | A1 * | 10/2015 | David | H01F 1/447 451/287 |
| 2016/0016282 | A1 * | 1/2016 | Chen | B24B 37/30 451/526 |
| 2016/0096251 | A1 * | 4/2016 | Zhang | B24B 37/042 700/164 |
| 2016/0256978 | A1 | 9/2016 | Tang et al. | |
| 2017/0274497 | A1 * | 9/2017 | Lau | B24B 37/26 |
| 2017/0274498 | A1 * | 9/2017 | Oh | B24B 37/10 |
| 2017/0368663 | A1 * | 12/2017 | Yang | B24B 37/10 |
| 2018/0281150 | A1 * | 10/2018 | Chen | B24B 37/22 |

FOREIGN PATENT DOCUMENTS

| | | | | |
|---|---|---|---|---|
| CN | 106312796 | | 1/2017 | |
| CN | 108326730 | A * | 7/2018 | B24B 21/06 |
| DE | 112016000979 | T5 * | 1/2008 | B24B 37/24 |
| JP | H05-013389 | | 1/1993 | |
| JP | 2000-033553 | | 2/2000 | |
| JP | 2001-353656 | | 12/2001 | |
| JP | 2002-036097 | | 2/2002 | |
| JP | 2002036097 | A * | 2/2002 | B24B 37/30 |
| JP | 3595266 | B2 * | 12/2004 | B24B 37/30 |
| JP | 4151799 | B2 * | 9/2008 | B24B 37/26 |
| JP | 4916638 | B2 * | 4/2012 | B24B 37/20 |
| TW | 438648 | B * | 4/2000 | H01L 21/302 |
| TW | 467803 | B * | 12/2001 | |
| TW | 496812 | B * | 8/2002 | B24B 37/16 |
| TW | 569330 | B * | 1/2004 | |
| TW | 200404648 | A * | 4/2004 | B24B 37/24 |
| TW | 1284582 | B * | 8/2007 | B24B 37/22 |
| TW | 201726313 | A * | 8/2017 | B24B 37/20 |
| TW | 201726316 | | 8/2017 | |
| TW | 201900426 | | 1/2019 | |
| WO | WO-9850201 | A1 * | 11/1998 | B24B 37/26 |
| WO | WO-2005018879 | A1 * | 3/2005 | A47L 13/17 |
| WO | WO-2016061506 | A1 * | 4/2016 | B24B 37/22 |

OTHER PUBLICATIONS

Cho et al., "Three-dimensional wafer scale hydrodynamic modeling for chemical mechanical polishing", Apr. 2000, Thin Solid Films 389 Ž2001. 254-260. (Year: 2000).*

PCT International Search Report and Written Opinion in International Appln. No. PCT/US2020/019629, dated Jun. 19, 2020, 11 pages.

Office Action in Japanese Appln. No. 2021-549491, mailed Sep. 27, 2022, 5 pages (with English translation).

Office Action in Chinese Appln. No. 202080019356.3, dated Feb. 11, 2023, 13 pages (with English translation).

Office Action in Taiwanese Appln. No. 109105797, dated Oct. 2, 2023, 19 pages (with English summary and search report).

Dai, "New Technology for Production of Important Use Wire Products," Metallurgical Industry Press, Nov. 31, 2001, 5 pages (with English abstract).

Office Action in Chinese Appln. No. 202080019356.3, dated Nov. 13, 2023, 13 pages (with English translation).

* cited by examiner

CONTROLLING CHEMICAL MECHANICAL POLISHING PAD STIFFNESS BY ADJUSTING WETTING IN THE BACKING LAYER

CROSS-REFERENCE TO RELATED APPLICATIONS

This application claims priority to U.S. Provisional Application Ser. No. 62/841,769, filed May 1, 2019, and claims priority to U.S. Provisional Application Ser. No. 62/812,212, filed Feb. 28, 2019, both of which are incorporated by reference.

TECHNICAL FIELD

The present disclosure relates to chemical mechanical polishing of substrates.

BACKGROUND

An integrated circuit is typically formed on a substrate by the sequential deposition of conductive, semiconductive, or insulative layers on a silicon wafer. One fabrication step involves depositing a filler layer over a non-planar surface and planarizing the filler layer. For certain applications, the filler layer is planarized until the top surface of a patterned layer is exposed. A conductive filler layer, for example, can be deposited on a patterned insulative layer to fill the trenches or holes in the insulative layer. After planarization, the portions of the conductive layer remaining between the raised pattern of the insulative layer form vias, plugs, and lines that provide conductive paths between thin film circuits on the substrate. For other applications, such as oxide polishing, the filler layer is planarized until a predetermined thickness is left over the non planar surface. In addition, planarization of the substrate surface is usually required for photolithography.

Chemical mechanical polishing (CMP) is one accepted method of planarization. This planarization method typically requires that the substrate be mounted on a carrier or polishing head. The exposed surface of the substrate is typically placed against a rotating polishing pad. The carrier head provides a controllable load on the substrate to push it against the polishing pad. An abrasive polishing slurry is typically supplied to the surface of the polishing pad.

SUMMARY

In one aspect, a polishing pad for a chemical mechanical polishing apparatus includes a polishing layer having a polishing surface a backing layer formed of a fluid-permeable material and having a lower surface configured to be secured to a platen and an upper surface secured to the polishing layer, and a plurality of seals including a first seal that circumferentially seals an edge of the backing layer and a second seal that seals and separates the backing layer into a first region and a second region.

In another aspect, a chemical mechanical polishing system includes a platen, a polishing pad that includes a polishing layer having a polishing surface and a backing layer formed of a fluid-permeable material and having a lower surface secured to the platen and an upper surface secured to the polishing layer, a plurality of seals including a first seal that circumferentially seals an edge of the backing layer, and a second seal that seals and separates the backing layer into a first region and a second region, and a fluid source coupled to the backing layer to direct fluid into the first region and second region of the backing layer.

In another aspect, a method of controlling stiffness of a backing layer of a polishing pad in a chemical mechanical polishing system includes controlling flow of liquid into first and second regions of a fluid-permeable backing layer of the polishing pad that are separated by a seal.

Implementations may include one or more of the following features.

The backing layer may have an open-cell structure. The backing layer may include a polymer matrix having interconnected voids therein.

At least some of the plurality of seals may be provided by portions of the backing layer that are impregnated with a sealant material. At least some of the plurality of seals may be provided by crimped portions of the backing layer. The first region may surround the second region. The first region and the second region may be concentric.

The fluid source may be configured to independently control fluid flow into the first region and the second region. The fluid source may include a plurality of independently controllable pumps.

A plurality of passages may extend through the platen and a plurality of vents may permit fluid flow into the first region and second region from the plurality of passages. The plurality of vents may project from the platen into the backing layer. The plurality of vents may include a first multiplicity of vents in the first region and a second multiplicity of vents in the second region. The first multiplicity of vents may be spaced at equidistant intervals within the first region and the second multiplicity of vents may be spaced at equidistant intervals within the second region. The liquid can be water.

Controlling flow of liquid into the first region and second region can include flowing liquid through vents that project from a platen into the backing layer.

Implementations may optionally include, but are not limited to, one or more of the following advantages. Polishing non-uniformity, e.g., caused by variations in stiffness across the backing layer due to wetting of the backing layer can be controlled and corrected. Another advantage to controlling the polishing pad stiffness is that different zones with varying stiffness can be created to control polishing rates at multiple regions of the wafer, e.g., to perform edge-correction or to correct for slow or fast removal zones caused by differences in slurry distribution.

The details of one or more implementations are set forth in the accompanying drawings and the description below. Other aspects, features, and advantages will be apparent from the description and drawings, and from the claims.

BRIEF DESCRIPTION OF THE DRAWINGS

Like reference numbers and designations in the various drawings indicate like elements.

DETAILED DESCRIPTION

Fluids, such as a polishing fluid, can be retained in and spread through the backing layer (e.g., by capillary action). Accumulation of fluid in the backing layer can result in uneven stiffness of the pad, which can result in uneven polishing rates between wetter regions and dryer regions of the backing layer. Additionally, as fluid seeps into the backing layer, over time the accumulation of fluid can result changes in the size of the wetted region, which can lead to wafer to wafer variation. However, the stiffness of a polishing pad can be controlled by pumping fluid into sealed regions of a backing layer.

Figure 1:
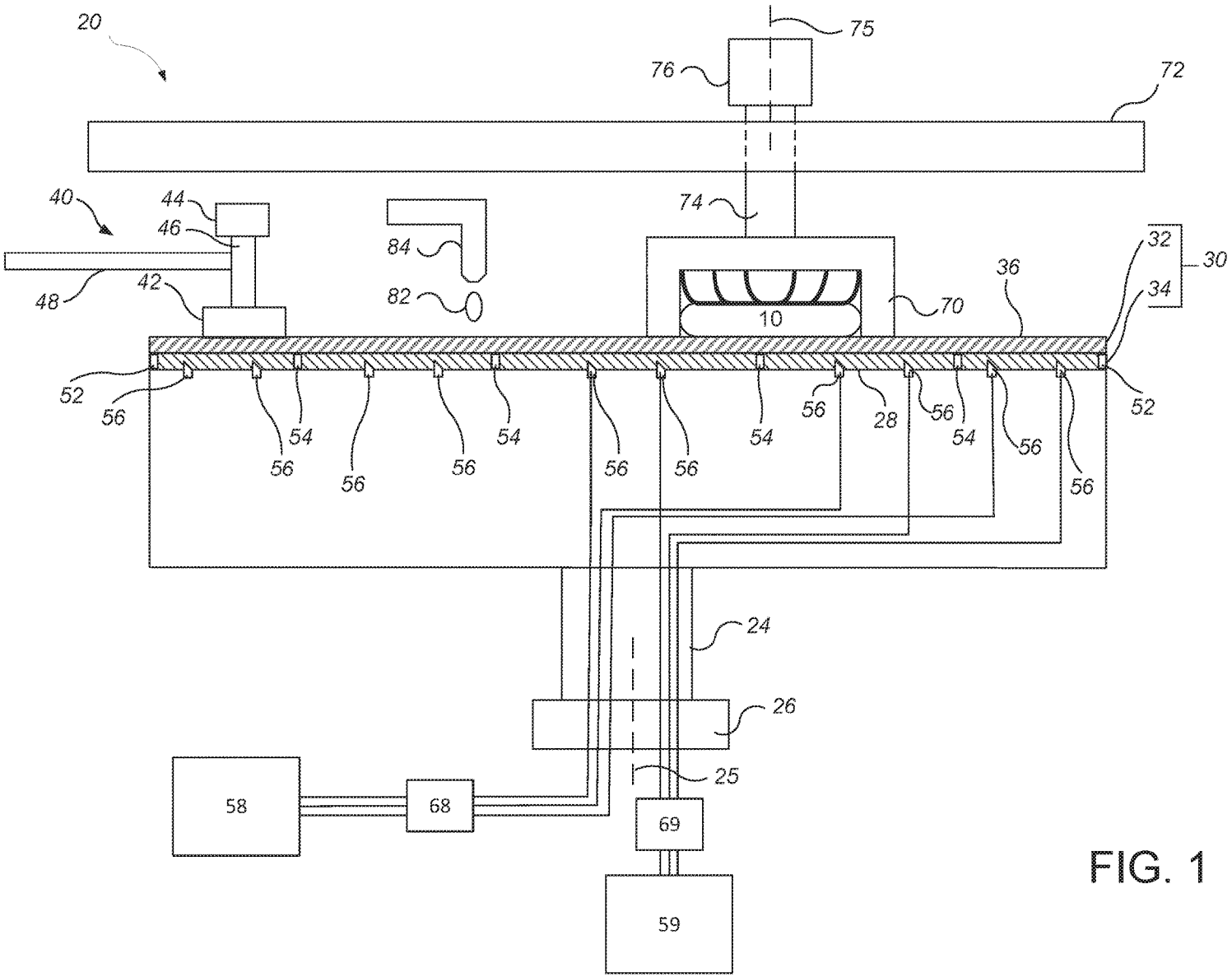
FIG. 1 shows a schematic cross-sectional view of a chemical mechanical polishing system.

FIG. 1 shows a polishing system 20 operable to polish a substrate 10. The polishing system 20 includes a disk-shaped platen 22 on which a polishing pad 30 with a polishing surface 36 is situated. The platen 22 is operable to rotate about an axis 25. A motor 26 can turn a drive shaft 24 to rotate the platen 22.

The polishing pad 30 can be secured to the upper surface 28 of the platen 22, for example, by a layer of adhesive 66 (described in more detail below). When worn, the polishing pad 30 can be detached and replaced.

The polishing system 20 can include a polishing liquid delivery arm 84 and/or a pad cleaning system such as a rinse fluid delivery arm. During polishing, the arm 84 is operable to dispense a polishing liquid 82, e.g., slurry with abrasive particles, onto the polishing pad 30. In some implementations, the polishing system 20 include a combined slurry/rinse arm.

The polishing system 20 can include a conditioner system 40 with a rotatable conditioner head 42 to maintain the surface roughness of the polishing surface 36 of the polishing pad 30. The conditioner head 42 can be a removable conditioning disk. A drive shaft 46 can connect the conditioner head 42 to a motor 44 which can drive the conditioner head 42. The conditioner head 42 can also be positioned at the end of an arm 48 that can swing so as to sweep the conditioner head 42 radially across the polishing pad 30.

A carrier head 70 is operable to hold the substrate 10 against the polishing pad 30. The carrier head 70 is suspended from a support structure 72, for example, a carousel or track, and is connected by a carrier drive shaft 74 to a carrier head rotation motor 76 so that the carrier head can rotate about an axis 75. In addition, the carrier head 70 can oscillate laterally across the polishing pad, e.g., by moving in a radial slot in the carousel as driven by an actuator, by rotation of the carousel as driven by a motor, or movement back and forth along the track as driven by an actuator.

The polishing pad 30 is a two-layer polishing pad with a polishing layer 32 and a backing layer 34. The backing layer 34 has an edge seal 52 and one or more internal seals 54. The backing layer 34 can have an open-cell structure (e.g., a solid foam having interconnected pores that extend through the backing layer) that is fluid permeable. In particular, the backing layer can be formed of a polymer matrix material with voids in the matrix providing the interconnected pores. The pores can occupy about 10-50%, e.g., 30% of the volume of the backing layer. The backing layer can be microporous, e.g., the pores can have an average diameter of about 10 to 100 microns. In contrast, the edge seal 52 and the internal seals 54 are fluid impermeable.

During polishing, some of the polishing fluid, e.g., the slurry, can flow over the sides of the platen 24. However, as shown in the example of FIG. 1, the perimeter of the backing layer 34 is sealed by an edge seal 52. The edge seal 52 prevents fluid, e.g., the polishing fluid that flows over the side platen 24, from seeping into the backing layer 34.

The backing layer 34 also has a plurality of internal seals 54 positioned within the backing layer 34. The internal seals 54 divide the backing layer 34 into multiple regions 50 (see FIGS. 3A, 3B, 4A, 4B). For example, assuming the seals 52, 54 are annular, a first annular region can defined by the area between the edge seal 52 and the outermost internal seal 54, a second annular region can be defined by the area between the outermost internal seal 54 and the next outermost internal seal 54, etc. The internal seals 54 provide a barrier to prevent fluid flow between the regions 50 of the backing layer 34.

The edge seal 52 and the internal seals 54 can be annular, e.g., circular. Moreover, the edge seal 52 and the internal seals 54 can be concentric with the center of the backing layer 34. The internal seals 54 need not form circular arcs, but have other shapes (e.g., wavy, straight lines, etc.). In addition, the internal seals 54 can form other shapes within the backing layer 34 (e.g., polygons, a cross-hatched pattern, etc.) and divide the backing layer 34 into regions of other shapes, e.g., concentric polygons, a rectangular array, etc.).

Figure 4A:
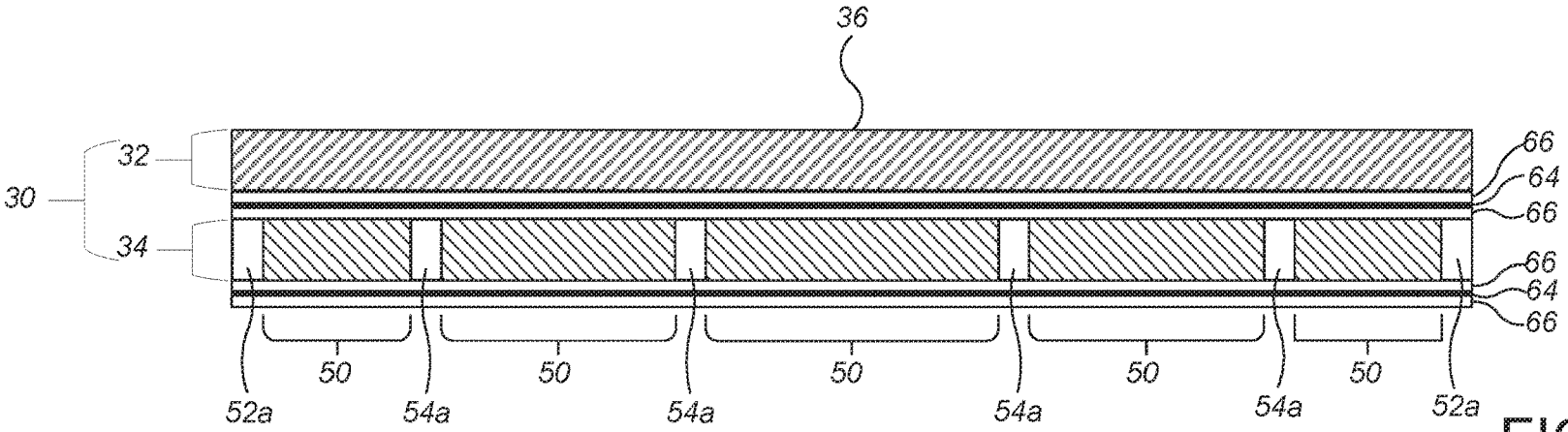
FIG. 4A shows a schematic cross-sectional view of a polishing layer and a backing layer with an impregnated seal.
Figure 4B:
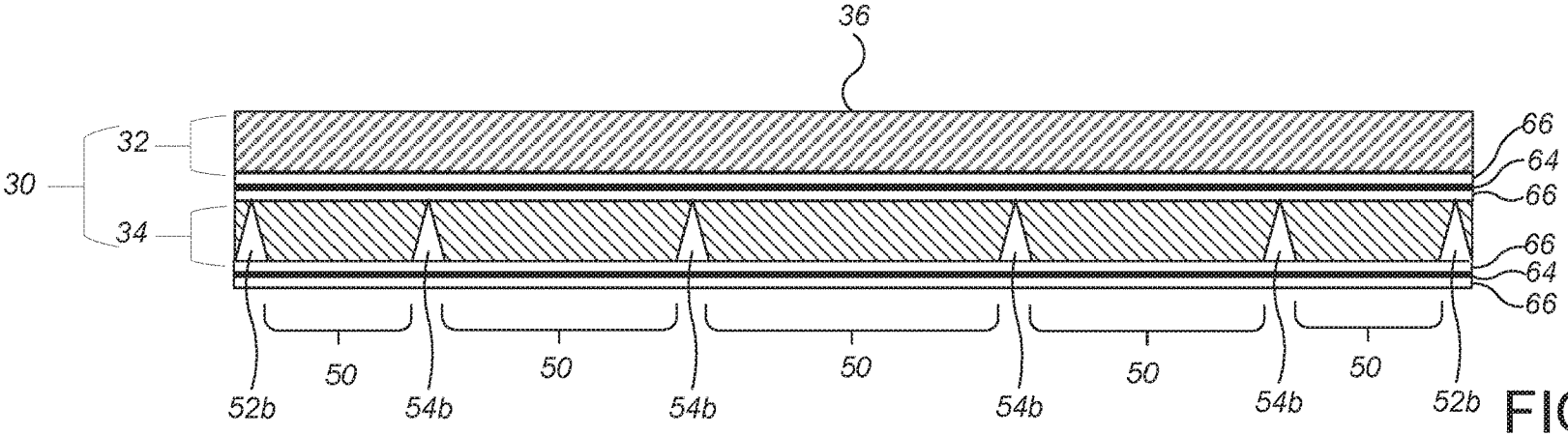
FIG. 4B shows a schematic cross-sectional view of a polishing layer and a backing layer with a crimped seal.

The edge seal 52 and the internal seals 54 can be formed, for example, by impregnating the backing layer 34 with a sealant material (see FIG. 4A), or by crimping the backing layer 34 (see FIG. 4B).

One or more passages extend through the platen, and one or more vents 56 permit fluid flow into and/or out of the regions 50 of the backing layer 34 from the one or more passages. The vents 56 can project upward from the platen 22. The vents can be formed from a body that is more rigid than the backing layer 34, and that has an internal conduit for fluid flow. For example, the vents 56 can be needles or other similar injection devices. Assuming that the vents project up from platen 20, when the polishing pad 30 is lowered onto the platen 20, the vents 56 can puncture and extend into the backing layer 34.

The vents 56 can inject fluid (e.g., water, air) into the separate regions 50 of the backing layer 34. The stiffness of the polishing pad 30 be controlled by controlling fluid flow into the regions 50 of backing layer 34 via the vents 56. Wetting and drying of the regions 50 of backing layer 34 can be accomplished by pumping liquid, e.g., water, into the regions 50 and pumping liquid out the regions 50 via the vents 56. For example, a vent 56 can be used for wetting of the associated region 50 of the backing layer 34 by pumping liquid into the region 50 of the backing layer 34. In another example, a vent 56 can be used for drying the associated region 50 of the backing layer 34 by pumping liquid out of the regions 50 of the backing layer 34. In another example, a vent 56 can be used for drying the associated region 50 of the backing layer 34 by pumping air into the region 50 of the backing layer 34. For example, a region 50 of the backing layer 34 that is wet with water can have air injected into it to replace the water and dry the region 50 (e.g., effectively "push out" the water with the air).

The fluids can be urged into the regions 50 of the backing layer 34, e.g., using a fluid pump 68, e.g., a centrifugal pump, peristaltic pump, etc. The fluids can be drawn out of the regions 50 of the backing layer 34, e.g., using a vacuum source 69, e.g., a pump or facilities vacuum line. Assuming a single pump were to be used to pump fluid into the entirety of a 30-inch diameter backing layer, the maximum fluid flowrate of the pump should be around 100 ml to 1 liter per minute. Similarly, assuming a single pump were to be used to pump fluid out of a 30-inch diameter backing layer, the maximum fluid flowrate should be around 100 ml to 1 liter per minute. However, where there are multiple pumps used for multiple regions of the backing layer, the maximum flow rate of the pump can be correspondingly reduced.

The optimal flow rate for an individual vent can depend on the number of vents 56 within a region 50 and the size of the region. Exemplary fluid flow rates, e.g., for a 30-inch diameter backing layer 34, are described in Table 1 below:

TABLE 1 exemplary fluid flowrates for a 30-inch diameter backing layer

| | | Number of vents | | | | |
|---|---|---|---|---|---|---|
| Unit = cc/min | | 4 | 8 | 16 | 32 | 64 |
| Number of regions | 1 | 145 | 72.50 | 36.25 | 18.13 | 9.06 |
| | 2 | 72.50 | 36.25 | 18.13 | 9.06 | 4.53 |
| | 4 | 36.25 | 18.13 | 9.06 | 4.53 | 2.27 |
| | 8 | 18.13 | 9.06 | 4.53 | 2.27 | 1.13 |
| | 16 | 9.06 | 4.53 | 2.27 | 1.13 | 0.57 |

The fluid pumped into the regions 50 of the backing layer 34 can be provided by a fluid source 58. For example, the fluid source 58 can be a reservoir that is connected to the vents 56. The fluid source 58 can be located within the platen 22. The fluid source 58 can be connected to the vents 56 using the passages through the platen 22.

The fluid can be pumped into the regions 50 of the backing layer 34 using the pump 68. In some implementations, multiple pumps can be used to can independently control fluid flow along each conduit connecting the fluid source 58 to each vent 56.

The fluids can be drawn out of the regions 50 of the backing layer 34 using the vacuum source 69. If each conduit is connected to a separate vacuum source 69, e.g., a different pump, then fluid flow along each conduit can be independently controlled. The vacuum source 69 can be located within the platen 22. The vacuum source 69 can be connected to the vents 56 using conduits through the platen 22.

Fluid flow can be independently controlled in each region 50. For example, the pump 68 can provide fluid into the first region (e.g., the region of the backing layer 34 that is defined by the edge seal 42 and the outermost internal seal 54) using the vents 56 corresponding to the first region, and at the same time provide fluid into the second region (e.g., the region of the backing layer 34 that is defined by the outermost internal seal 54 and the second outermost internal seal 54) using the vents 56 corresponding to the second region. The amount of fluid pumped into the first region can be more than the amount of fluid pumped into the second region. In some implementations, the amount of fluid pumped into the first region can be less than the amount of fluid pumped into the second region. In some implementations, the amount of fluid pumped into the first region can be the same as the amount of fluid pumped into the second region. Similarly, the pump 69 can remove more fluid the first region than the second region, less fluid from the first region than the second region, or the same amount of fluid from the first region and the second region.

Varying the fluid flow into a regions 50 of the backing layer 34 can control the stiffness of the polishing pad 30 corresponding to that regions 50, which ultimately affects the polishing characteristics the substrate 10 for that region 50 of the backing layer 34. In general, increased stiffness results in an increased polishing rate, although there can be secondary effects, such as a reduction in polishing uniformity.

For example, if the second region of the backing layer 34 is wetter than a first region of the backing layer 34, the portion of the polishing pad 30 corresponding to the second region will be stiffer relative to the portion of the polishing pad 30 corresponding to the first region. Thus, if the carrier head 70 positions a center portion of the substrate 10 over a portion of the polishing pad 30 that corresponds to the second region, and positions an edge portion of the substrate 10 over a portion of the polishing pad 30 that corresponds to the first region, the polishing system 10 can establish different polishing rates in different portions of the substrate 10.

By controlling the wetness and dryness of the regions 50 of the backing layer 34, the regions 50 can be configured to provide the polishing pad 30 with a substantially uniform stiffness, thus reducing the wear and tear on the polishing pad 30 and increasing the lifespan of the polishing pad 30. Additionally, different polishing rates in different portions of the substrate 10 can provide correction of the substrate 10, e.g., by reducing the polishing of the edge of the substrate 10 to result in a more uniform polishing of the substrate 10.

Figure 2:
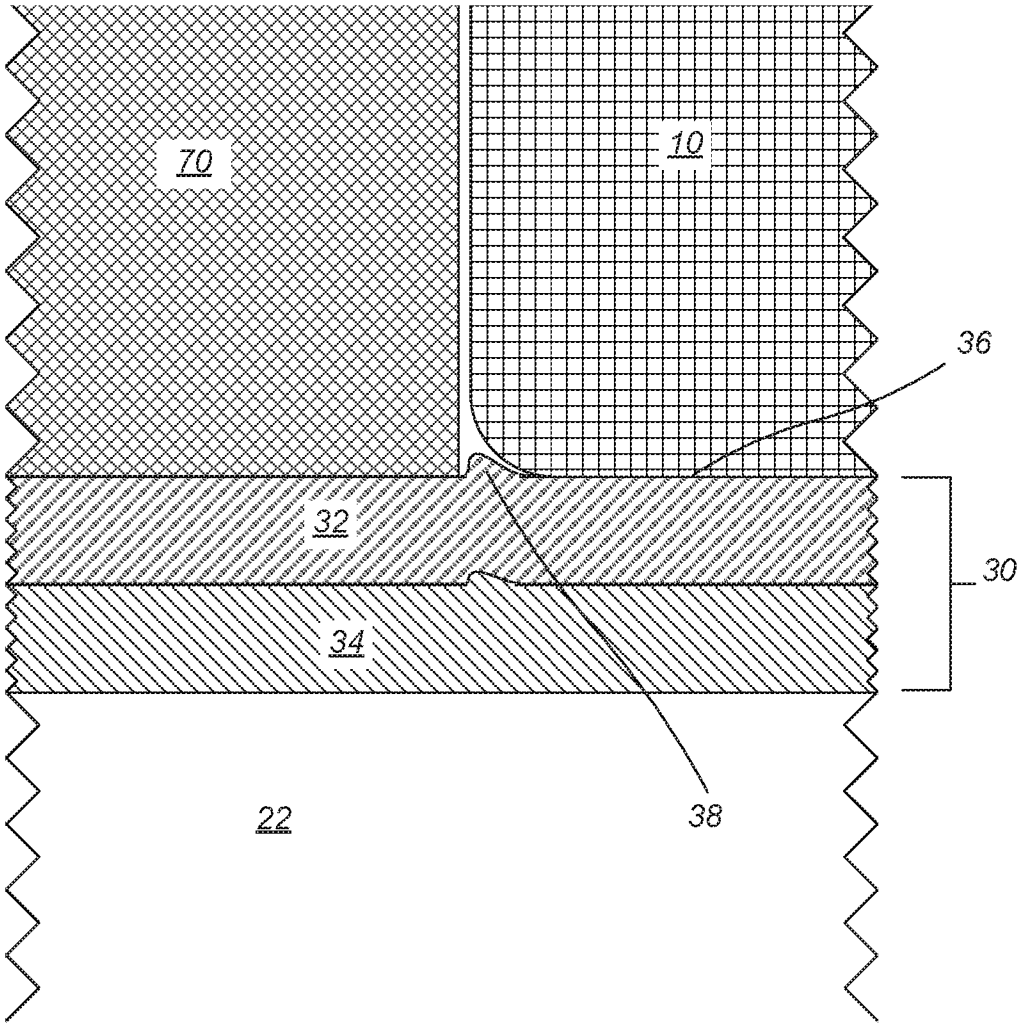
FIG. 2 shows a schematic close-up cross-sectional view of a pinched polishing pad.

Additionally, the amount of fluid in the regions 50 of the backing layer 34 can be controlled to reduce the effect of "pinching" of the polishing pad 30, particularly in-between the substrate 10 and a retaining ring of the carrier head 70. As illustrated in FIG. 2, pinching 38 can occur when the substrate 10 and/or the carrier head 70 press on the polishing pad 30 to "pinch" or "squeeze" a portion of the polishing pad 30. Pinching 38 of the polishing pad 30 can result in an increased polishing rate. To reduce the effect of pinching 38, the vents 56 can inject fluid into a regions 50 of the backing layer 34 that underlies the pinching 38 to stiffen the polishing pad 30 (e.g., reduce the flexibility of the polishing pad 30). In some implementations, the vents 56 can reduce the fluid in a regions 50 of the backing layer 34 that is underlying the pinching 38 to soften the polishing pad 30 (e.g., reduce how stiff the polishing pad is and reduce the polishing rate of the polishing pad 30).

Figure 3A:
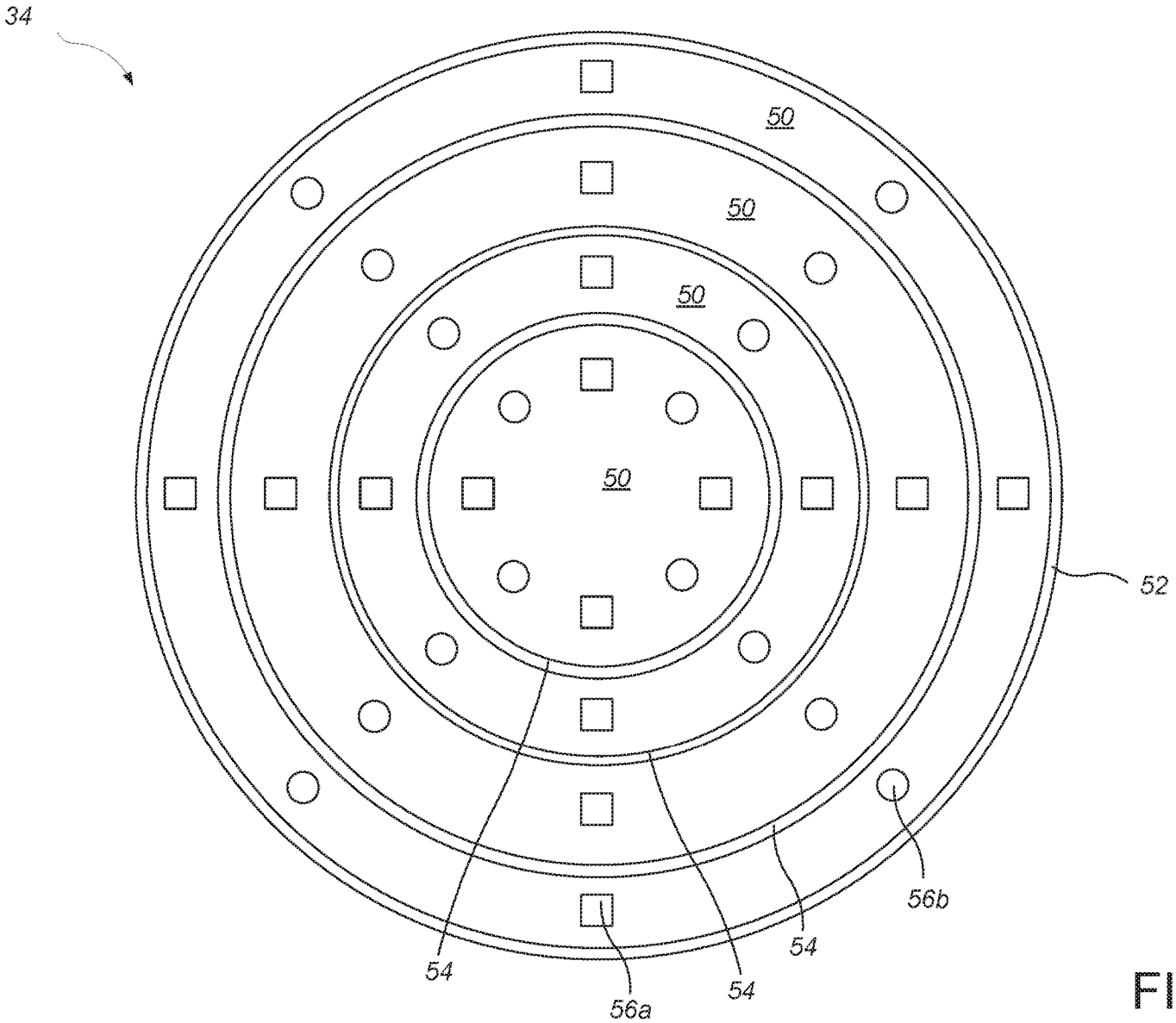
FIG. 3A shows a schematic top view of an exemplary backing layer.
Figure 3B:
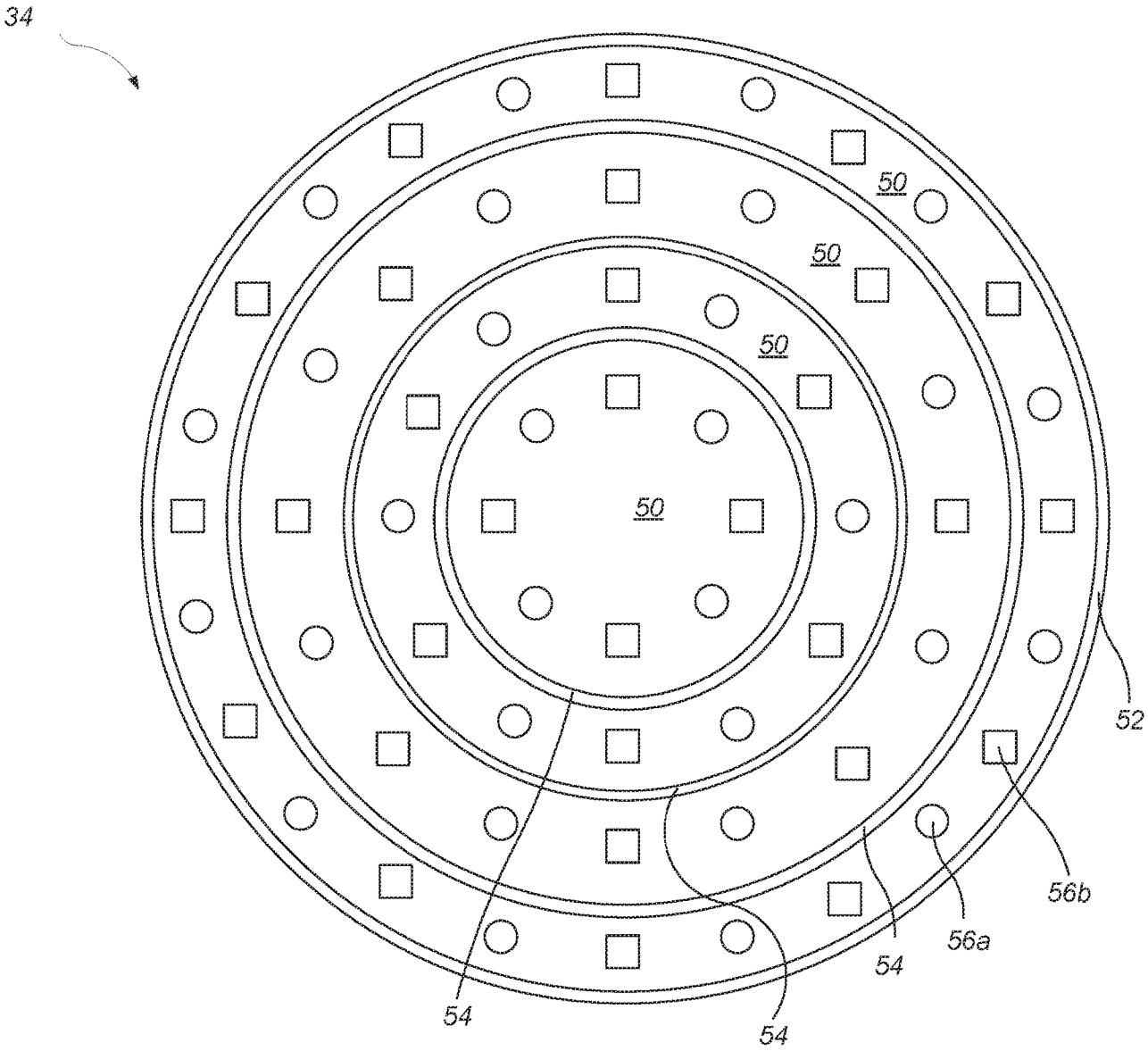
FIG. 3B shows a schematic top view of an exemplary backing layer.

As illustrated in FIGS. 3A and 3B, the vents 56 can include inlet vents 56*a* (e.g., to pump fluids into a region 50) and outlet vents 56*b* (e.g., to pump out fluids out of a region 50). Referring to FIG. 3A, the inlet vents 56*a* and the outlet vents 56*b* can be arranged in a radial pattern, e.g., rows of vents extending along the radii of the polishing pad 30. The rows of inlet vents 56*a* and outlet vents 56*b* can alternate within each regions 50 of backing layer 34. Further, the vents within the row of vents 56 extending along the radii of the polishing pad 30 can be equidistant from one another. Referring to FIG. 3B, the inlet vents 56*a* and the outlet vents 56*b* can be arranged such that the space between each of the inlet vents 56*a* and the outlet vents 56*b* within one region 50 is approximately the same as the space between each of the inlet vents 56*a* and the outlet vents 56*b* of another region 50. While not expressly illustrated, other arrangements, patterns, and numbers of inlet vents and outlet vents are possible. Further, the number, width, shape (e.g., circular, polygonal, or other shape), and concentricity (e.g., concentric regions or non-concentric regions) of regions 50 are also possible.

As illustrated in FIGS. 4A and 4B, a fluid-impermeable film 64 (e.g., a plastic film or a wax film) can be located between the top pad 32 and the upper surface of the backing layer 34. The film 64 can be a thin plastic layer. The film 64 can prevent fluids from passing from a first region 50 and into a second region 50. In some implementations, the film 64 is secured to the top pad 32 and/or the backing layer 34 using an adhesive 66 (e.g., pressure sensitive adhesive, tape, or glue). In some implementations, the film 64 is located on the lower surface of the backing layer 34. The film 64 is secured to the lower surface of the backing layer 34 using the adhesive 66, and secured to the platen 22 (not illustrated) using the adhesive 66.

Referring now to FIG. 4A, the edge seal 52 and the internal seals 54 can be provided by portions of the backing layer 34 that are impregnated with a sealant material. For example, the impregnated edge seal 52*a* and impregnated seals 54*a* can be composed of a polyurethane or an epoxy resin, or other polymers, such as polyethylene terephthalate (PET), polyvinyl chloride (PVC), or polypropylene (PP). This sealant material fills the pores in the polymer matrix in the area of the seal, thus preventing fluid flow.

Referring now to FIG. 4B, the edge seal 52 and the internal seals 54 can be provided by crimped portions of the backing layer 34. The crimping can be done, for example, by crimping or embossing the backing layer 34. The crimping collapses the pores in the area of the seal, thus preventing fluid flow.

In some implementations, the edge seal 52 and the seals 54 can be composed of a combination of impregnated seals (e.g., 52*a* and 54*a*) and crimped seals (e.g., 52*b* and 54*b*).

If a window or aperture extends through the polishing pad, then an additional seal can be used to seal the inner edge of the backing layer 34 adjacent the window or aperture.

As used in the instant specification, the term substrate can include, for example, a product substrate (e.g., which includes multiple memory or processor dies), a test substrate, a bare substrate, and a gating substrate. The substrate can be at various stages of integrated circuit fabrication, e.g., the substrate can be a bare wafer, or it can include one or more deposited and/or patterned layers. The term substrate can include circular disks and rectangular sheets.

The above described polishing system and methods can be applied in a variety of polishing systems. Either the polishing pad, or the carrier head, or both can move to provide relative motion between the polishing surface and the substrate. The polishing pad can be a circular (or some other shape) pad secured to the platen. The polishing layer can be a standard (for example, polyurethane with or without fillers) polishing material, a soft material, or a fixed-abrasive material. Terms of relative positioning are used; it should be understood that the polishing surface and substrate can be held in a vertical orientation or some other orientation.

Particular embodiments of the invention have been described. Other embodiments are within the scope of the following claims. For example, the actions recited in the claims can be performed in a different order and still achieve desirable results.

What is claimed is:

1. A polishing pad for a chemical mechanical polishing apparatus, comprising:

a polishing layer of the polishing pad having a polishing surface;

a backing layer of the polishing pad formed of a fluid-permeable material and having a lower surface configured to be secured to a platen and an upper surface secured to the polishing layer; and a plurality of fluid-impermeable seals including a first seal that circumferentially seals an edge of the backing layer and a second seal that seals and separates the backing layer into a first region and a second region, wherein the plurality of fluid-impermeable seals extend from the lower surface of the backing layer to the upper surface of the backing layer.

2. The polishing pad of claim 1, wherein the backing layer has an open-cell structure.

3. The polishing pad of claim 2, wherein the backing layer comprises a polymer matrix having interconnected voids therein.

4. The polishing pad of claim 1, wherein at least some of the plurality of fluid-impermeable seals are provided by portions of the backing layer that are impregnated with a sealant material.

5. The polishing pad of claim 1, wherein at least some of the plurality of fluid-impermeable seals are provided by crimped portions of the backing layer.

6. The polishing pad of claim 1, wherein the first region surrounds the second region.

7. The polishing pad of claim 6, wherein the first region and second region are concentric.

8. A chemical mechanical polishing system, comprising:

a platen;

a polishing pad that includes:

a polishing layer having a polishing surface; and a backing layer formed of a fluid-permeable material and having a lower surface secured by an adhesive layer to the platen and an upper surface secured to the polishing layer;

a plurality of fluid-impermeable seals including a first fluid-impermeable seal that circumferentially seals an edge of the backing layer, and a second fluid- impermeable seal that seals and separates the backing layer into a first region and a second region;

a plurality of vents extending through the platen and the adhesive layer and into the backing layer and configured to permit fluid flow from the platen to the backing layer of the polishing pad; and a fluid source coupled to the backing layer to direct fluid into the first region and second region of the backing layer.

9. The system of claim 8, wherein the fluid source is configured to independently control fluid flow into the first region and the second region.

10. The system of claim 9, wherein the fluid source includes a plurality of independently controllable pumps.

11. The system of claim 8, comprising a plurality of passages wherein the plurality of vents permit fluid flow into the first region and second region through a plurality of passages.

12. The system of claim 11, wherein the plurality of vents comprise a material more rigid than a material of the backing layer.

13. The system of claim 11, wherein the plurality of vents of include a first multiplicity of vents in the first region and a second multiplicity of vents in the second region.

14. The system of claim 13, wherein the first multiplicity of vents are spaced at equidistant intervals within the first region and the second multiplicity of vents are spaced at equidistant intervals within the second region.

15. The system of claim 8, wherein at least some of the plurality of fluid-impermeable seals are provided by portions of the backing layer that are impregnated with a sealant material.

16. The system of claim 8, wherein at least some of the plurality of fluid-impermeable seals are provided by crimped portions of the backing layer.

17. A method of controlling stiffness of a backing layer of a polishing pad in a chemical mechanical polishing system, comprising:

controlling flow of liquid, through a first passage extending from a platen disposed below the polishing pad and into the polishing pad, into a first region of a fluid-permeable backing layer of the polishing pad; and independently controlling flow of liquid through a second passage, extending from the platen and into the polishing pad, into a second region of the fluid-permeable backing layer that is separated from the first region by a fluid-impermeable seal to control the stiffness of the backing layer by independently managing distribution of the liquid in the first and second regions based on operational parameters.

18. The method of claim 17, wherein the backing layer has an open-cell structure.

19. The method of claim 17, wherein the liquid is water.

20. The method of claim 17, wherein controlling flow of liquid into the first region and second region comprise flowing liquid through vents that project from a platen into the backing layer.

* * * * *